United States Patent [19]

Heller et al.

[11] 4,042,273

[45] Aug. 16, 1977

[54] RAIL WHEEL

[75] Inventors: Wilhelm Heller, Rheinhausen; Walter Knorr, Bochum, both of Germany

[73] Assignee: Fried. Krupp Huttenwerke AG, Bochum, Germany

[21] Appl. No.: 579,188

[22] Filed: May 20, 1975

[51] Int. Cl.[2] ..... B60B 17/00

[52] U.S. Cl. ..... 295/30; 75/123 B; 75/123 J; 75/123 N; 75/124; 75/125; 75/126 B; 75/126 F; 75/126 J; 148/36

[58] Field of Search ..... 75/123 N, 123 J, 123 B, 75/124, 125, 126 B, 126 E, 126 F, 126 J; 148/36; 29/168; 295/30

[56] References Cited

U.S. PATENT DOCUMENTS

| | | | |
|---|---|---|---|
| 2,798,805 | 7/1957 | Hodge et al. | 75/123 B |
| 3,178,279 | 4/1965 | Nakamura | 75/124 |
| 3,357,822 | 12/1967 | Miyoshi et al. | 148/36 |
| 3,518,080 | 6/1970 | Jarleborg et al. | 75/124 |
| 3,661,656 | 5/1972 | Jarleborg | 148/36 |
| 3,726,723 | 4/1973 | Coldren et al. | 148/36 |
| 3,783,040 | 1/1974 | Ballance et al. | 148/36 |
| 3,807,990 | 4/1974 | Gohda et al. | 148/36 |

FOREIGN PATENT DOCUMENTS

| | | | |
|---|---|---|---|
| 46-42700 | 8/1968 | Japan | 75/124 |
| 47-46645 | 11/1968 | Japan | 75/123 N |

*Primary Examiner*—Arthur J. Steiner
*Attorney, Agent, or Firm*—Burgess, Dinklage & Sprung

[57] ABSTRACT

A rail wheel comprising a wheel rim, wheel disc and a wheel hub wherein at least the wheel rim consists essentially of a steel having the following composition:

0.04 to 0.12 weight percent carbon
0.20 to 0.70 weight percent silicon
3.5 to 5.0 weight percent mangangese
0.005 to 0.025 weight percent nitrogen
0.002 to 0.4 weight percent niobium = vanadium,
the balance being iron with the usual impurities; a process for forming such rail wheel.

15 Claims, No Drawings

RAIL WHEEL

BACKGROUND OF THE INVENTION

1. Field of the Invention

This invention relates to a rail wheel. This invention more particularly relates to a new steel for a rail wheel. The invention is particularly concerned with a rail wheel of a steel which is substantially free of abrasion martensite and is characterized by a tensile strength of at least 900 N/mm$^2$ and a yield point of at least 650 N/mm$^2$, which rail wheel has a high resistance to rupture and a good abrasion resistance. This invention is also directed to a rail wheel of a steel containing components of bainitic structure.

2. Discussion of the Prior Art

Rail wheels for use on rail vehicles have long been known. Rail wheels heretofore employed are predominantly produced from unalloyed carbon steels. They are used in the naturally hard, normalized, heat-treated and tread heat-treated state. The rail wheel as a solid wheel can consist of one and the same steel or it can take the form of a composite material comprising a high-carbon material for the rail wheel rim interconnected with a softer carbon steel interior thereof which would form the wheel disc and/or wheel hub. Such a composite rail wheel is disclosed in U.S. Pat. No. 1,149,267.

High-carbon wheel rims have a structure which is more or less finely laminated pearlite. This structure and the chemical composition of the wheel rim impair the tenacity of the rail wheel. To such factor there must also be considered the abrasion martensite by block breaking or by slipping and sliding owing to the high carbon content of the steel. The high martensite hardness which results can lead to an acute danger of cracking the rail wheel.

In order to raise the tenacity in the rail wheel rim or in the entire rail wheel, it has been proposed to employ alloyed steels. With these alloyed steels, heat treatments consisting of hardening and tempering have been employed to provide the high tenacities. Even if a bainitic structure is produced by carefully adjusting the analysis by taking into account the given shape of the rail wheel and this is tempered in order to improve tenacity properties, the upper surface of the rail wheel is susceptible to damage by virtue of the abrasion martensite which is not removed by this treatment.

When the stress is very high, e.g., in high velocity rail traffic, considerable risks remain, as the resistance to rupture is inadequate because of the insufficient tenacity and the danger of formation of abrasion martensite.

Accordingly, it became desirable to provide a rail wheel from a steel composition where the rail wheel would be characterized by a high tensile strength of at leaast 900 N/mm$^2$. Moreover, it became desirable to provide such a rail wheel without expensive heat treatments of highly stressed wheel rims. Still moreover, it became desirable to provide a rail wheel, which rail wheel has a yield point of at least 650 N/mm$^2$ and had good resistance to rupture and high abrasion resistance. Furthermore, it became desirable to provide such a rail wheel which is not susceptible to the formation of abrasion martensite.

SUMMARY OF THE INVENTION

In accordance with the present invention there is provided a rail wheel comprising a rail wheel rim, a rail wheel disc and a rail wheel hub, wherein at least the rail wheel rim consists essentially of a steel having the following composition:

0.04 to 0.12 weight percent carbon
0.20 to 0.70 weight percent silicon
3.5 to 5.0 weight percent manganese
0.005 to 0.025 weight percent nitrogen
0.002 to 0.4 weight percent niobium + vanadium,
the balance being iron with the usual impurities.

Rail wheels and especially rail wheel rims of the present invention can preferably have a composition as follows:

0.07 to 0.12 weight percent carbon
0.20 to 0.50 weight percent silicon
4.0 to 5.0 weight percent manganese
0.04 to 0.12 weight percent niobium
0.007 to 0.012 weight percent nitrogen
0.005 to 0.025 weight percent metallic aluminum.

It is additionally preferred to provide a minimum proportion of carbon of 0.09 weight percent and/or a minimum manganese proportion of 4.5 weight percent. A minimum proportion of 0.3 weight percent molybdenum is also quite useful.

Generally speaking, the rail wheel steel composition contains 0.002 to 0.4 weight percent combined niobium and vanadium content. This is preferably provided using a niobium content in the range of 0.04 to 0.12 weight percent with additional vanadium employed to make up the desired value within the 0.002 to 0.4 weight percent range.

The steel composition can contain up to 2.0 weight percent copper; up to 0.5 weight percent molybdenum; up to 0.2 weight percent zirconium; up to 0.01 weight percent boron; up to 0.3 weight percent titanium, and up to 0.1 weight percent metallic aluminum. The manganese content referred to above can be altered by replacement with chromium. Thus, one can substitute between 1 and 1.5 weight percent of the manganese with chromium.

A preferred composition contains a minimum proportion of molybdenum of 0.5 weight percent, a minimum zirconium proportion of 0.02 weight percent, a minimum boron proportion of 0.002 percent and a minimum titanium content of 0.01 weight percent.

While it is understood that at the heart of the invention there is the use of such a steel composition to form a rail wheel rim, one can also prepare a unitary continuous rail wheel wherein the rim, the disc and the hub are all made from the same steel composition of the invention. In such instance, it is preferable that the steel composition be homogenous from the rim to the disc to the hub.

In accordance with the invention, the steel composition can be formulated from known components which supply the elements indicated above for the rail wheels. There are thus obtained rail wheels which have excellent tensile strength and yield point characteristics as well as high abrasion resistance and a freedom of tendency to form abrasion martensite. Preferably, the rail wheels have a tensile strength of at least 1000 N/mm$^2$ with a yield point in the range of 750–1000 N/mm$^2$. They are characterized by a high yield point ratio. Notwithstanding these characteristics, the rail wheels of the present invention have a tenacity against rupture and show no inclination for the formation of abrasion martensite.

Generally speaking, the wheels are provided by supplying a source of the elements indicated together with iron, and the elements are maintained in the molten form under the usual steel making conditions until the desired steel is obtained. This raw steel thereafter can be hot-formed at temperatures, say in the range of 1100° to 1200° C, for instance. Subsequently, they can be hot-formed or shaped at lower temperatures such as temperatures in the range of 900° to 1100° C, preferably 950° to 1050° C whence they are formed into the rail wheel.

The so hot-formed or hot-shaped rail wheel can thereafter be quenched down to normal temperatures employing a fluid such as water or air. Quenching is performed so as to cool the hot-shaped rail wheel from the elevated temperatures of, say, 600°-950° C down to temperatures of between 20° and 100° C. This quenching can be carried out by utilizing air as a quench medium wherein the quenching takes place over a period of between 1 and 2½ hours. Quenching can also be accomplished by use of liquid water.

There is thus provided a rail wheel having substantially improved characteristics and which can be provided without employing a process which requires special heat treatments or the like. Moreover, the rail wheel has a tensile strength of at least 900 N/mm² and a yield point of at least 650 N/mm².

In the refining of the steel to provide the rail wheel of the invention, it is expedient to provide a low hydrogen content in the rail wheel. For this purpose, a series of hydrogen removal processes can be employed. The steel can be melted low in hydrogen and/or it can be reduced by one of the known steel degassing treatments so as to reduce the relative amount of hydrogen to desired smaller values. Another procedure resides in precipitating the heat-formed wheels or wheel rims for the purpose of hydrogen removal, at room temperature or elevated temperature, especially in the region of 300° to 400° C. Such a means for the removal of hydrogen is well known.

The wheels of the wheel rims are preferably heat-formed in a heat from the raw ingot to the finished section. The cooling of the finished wheel or wheel rim can normally take place in air as outlined above. In order to enable a removal of hydrogen, a delayed cooling in air can also be performed. During the cooling in air a structure of bainite and ferrite results.

According to a preferred embodiment of the invention the wheels of the wheel rims are quenched in water or in another quenching medium after being heat formed. This accelerated cooling results in a pure bainite structure which surprisingly has a better tenacity to rupture than the structure resulting from the slower air cooling.

A particular advantage is seen in that the entire rail wheel can be prepared from one material which is abrasion-resistant, rupture-resistant and is free of any tendency to form abrasion martensite. These factors will be appreciated from the comparative examples set forth below.

In order to more fully illustrate the nature of the invention and the manner of practicing the same, the following examples are presented.

EXAMPLES

Examples 1-8

For the purpose of demonstrating the rail wheels of the invention vis-a-vis rail wheels made of steel according to prior art techniques, eight steels of various compositions pursuant to the invention were made. Additionally, wheel steels, steels No. 1 and No. 2, were made according to known procedures for the formation of rail wheels.

In Table 1 below there is set forth a chemical composition of prior art type rail wheels (steels 1 and 2) vis-a-vis rail wheels made pursuant to the present invention. In Table 2 there is set forth in tabular form the physical properties of these rail wheel steels from which it can be seen that the rail wheel steels of the present invention have consistently a higher yield point and generally a higher tensile strength than the steels of the prior art.

The elongation characteristics of the steels of the present invention coupled with the reduction of area particularly distinguish the steels of the present invention over prior art type steels.

The impact DVMF test and the ISO-V values also markedly distinguish the rail wheels of this invention over rail wheels of the prior art. Still other improvements are seen by a comparison of the bending change strength.

In Tables 1 and 2 the method by which the hot-formed rail wheels have been cooled to normal temperatures is set forth. The abbreviation L indicates that the quenching from the hot-forming or shaping temperatures to normal temperatures has been accomplished by the use of air. The abbreviation W refers to quenching with water.

The rail wheel steels 3 to 8 according to the invention have good technological properties for use as "rail wheel." The reduction of area is considerably over 50 % and the impact value according to the DVMF-test known in Germany or according to the internationally known ISO-V test show especially good values at temperatures of −30° C and room temperature respectively. Moreover the fatique strength (bending change strength) is clearly above 400 N/mm², as steel numbers 3 and 4 show.

Table 1

| Steel No. | Treatment State | Chemical Steel Composition of the Rail Wheel respectively Wheel Rim C | Si | Mn | Cu | Cr | Nb | V | N | Mo | Remarks | |
|---|---|---|---|---|---|---|---|---|---|---|---|---|
| 1 | Air cooling (L) | 0.75 | 0.25 | 1.1 | — | — | — | — | 0.005 | — | Rail class | Prior Art |
| 2 | (L) | 0.73 | 0.60 | 1.0 | — | 1.1 | — | — | 0.007 | — | Rail special class | |
| 3 | Air cooling (L) | 0.07 | 0.30 | 4.5 | — | — | 0.1 | — | 0.011 | — | Object of application | |
| 4 | or | 0.08 | 0.42 | 4.6 | — | — | 0.11 | — | 0.011 | — | " | |
| 5 | water | 0.07 | 0.28 | 4.2 | — | — | 0.1 | — | 0.012 | — | " | |
| 6 | quenching(W) | 0.09 | 0.29 | 4.5 | — | — | 0.05 | — | 0.012 | 0.37 | " | |
| 7 | according to | 0.12 | 0.28 | 4.1 | — | — | 0.10 | — | 0.012 | — | " | |
| 8 | Table 2 | 0.12 | 0.29 | 5.0 | — | — | 0.10 | — | 0.012 | — | " | |

All melts contain 0.005 to 0.25% Al

Table 2

| Steel No. | Treatment state Air cooling (L) Water quenching (W) | Mechanical Properties of the Rail Wheel Steels respectively Wheel Rim: Yield Point N/mm² σ0.2 | Tensile Strength N/mm² σB | Elongation δ5% | Reduction of Area ψ% | Impact DVMF Test −30° C Joule | Value ISO-V +20° C Joule | Bending change strength σBW N/mm² |
|---|---|---|---|---|---|---|---|---|
| 1 | L } Prior art | 550 | 962 | 13.5 | 23 | 9 | 9 | 325 |
| 2 | L } Prior art | 676 | 1130 | 11.4 | 22 | 9 | 8 | 370 |
| 3 | L | 775 | 1079 | 16.4 | 67 | 137 | 54 | 421 |
| 4 | L | 1020 | 1069 | 16.5 | 57 | 118 | 42 | 483 |
| 5 | L | 728 | 917 | 17.8 | 72 | — | 32 | — |
| | W | 966 | 1117 | 16.3 | 70 | — | 36 | |
| 6 | W | 1005 | 1189 | 16.3 | 70 | — | 13 | |
| 7 | L | 880 | 1086 | 15.8 | 64 | 92 | 11 | |
| | W | 1041 | 1230 | 15.7 | 66 | 105 | 13 | |
| 8 | L | 1077 | 1266 | 16.1 | 62 | 14 | 6 | |
| | W | 1064 | 1261 | 15.9 | 64 | 96 | | |

What is claimed is:

1. A rail wheel comprising a wheel rim, wheel disc, and wheel hub wherein at least the wheel rim consists essentially of a steel whose composition consists essentially of:

0.07 to 0.12 weight percent carbon
0.20 to 0.50 weight percent silicon
4.0 to 5.0 weight percent manganese
0.04 to 0.12 weight percent niobium
0.007 to 0.012 weight percent nitrogen
0.005 to 0.025 weight percent metallic aluminum,
the balance being iron with the usual impurities.

2. A rail wheel according to claim 1 additionally containing copper in an amount up to 2 weight percent.

3. A rail wheel according to claim 1 additionally containing molybdenum in an amount up to 0.5 weight percent.

4. A rail wheel according to claim 1 additionally containing zirconium in an amount up to 0.2 percent by weight.

5. A rail wheel according to claim 1 additionally containing boron in an amount up to 0.01 weight percent.

6. A rail wheel according to claim 1 additionally containing titanium in an amount up to 0.3 weight percent.

7. A rail wheel according to claim 1 wherein the steel composition contains at least 0.09 weight percent carbon.

8. A rail wheel according to claim 1 wherein the steel contains at least 4.5 weight percent manganese.

9. A rail wheel according to claim 4 wherein the steel composition contains at least 0.3 weight percent molybdenum.

10. A rail wheel according to claim 1 having a tensile strength of at least 900 N/mm².

11. A rail wheel according to claim 10 having a tensile strength of over 1000 N/mm².

12. A rail wheel according to claim 1 having a yield point of at least 650 N/mm².

13. A rail wheel according to claim 12 wherein the steel of the wheel has a yield point of 750–1000 N/mm².

14. A rail wheel according to claim 1 wherein the steel of the wheel rim is free of any inclination toward the formation of abrasion martensite.

15. A rail wheel according to claim 1 wherein the steel of the wheel rim is characterized by having a pure bainite structure.

* * * * *